US007314387B1

(12) United States Patent
Liu

(10) Patent No.: US 7,314,387 B1
(45) Date of Patent: Jan. 1, 2008

(54) COMMUNICATION CONNECTOR WITH TWO LAYERED CORE MODULE

(75) Inventor: Lu-Ta Liu, Taipei (TW)

(73) Assignee: Lankom Electronics Co., Ltd. (TW)

( * ) Notice: Subject to any disclaimer, the term of this patent is extended or adjusted under 35 U.S.C. 154(b) by 0 days.

(21) Appl. No.: 11/542,049

(22) Filed: Oct. 3, 2006

(51) Int. Cl.
*H01R 13/66* (2006.01)

(52) U.S. Cl. ..... 439/620.11; 439/620.21; 439/676

(58) Field of Classification Search ..... 439/676, 439/941, 620.11, 620.12, 620.13, 620.17, 439/620.18, 620.21, 620.23
See application file for complete search history.

(56) References Cited

U.S. PATENT DOCUMENTS 6,811,442 B1 * 11/2004 Lien et al. ..... 439/620.07
6,976,877 B2 * 12/2005 Lien ..... 439/620.01
6,986,684 B1 * 1/2006 Lien ..... 439/620.07
7,121,898 B2 * 10/2006 Murr et al. ..... 439/676
7,153,158 B1 * 12/2006 Lee ..... 439/541.5

* cited by examiner

*Primary Examiner*—Hae Moon Hyeon
(74) *Attorney, Agent, or Firm*—Jackson Walker, LLP

(57) ABSTRACT

A communication connector includes a terminal seat with multiple legs extending from two adjacent sides of the terminal seat, a coil seat securely and electrically connected to the terminal seat and having coils respectively received in two isolated compartments defined in two adjacent sides of the coil seat, two side circuit boards respectively connected to opposed sides of the terminal seat to sandwich therebetween the coil seat and a resilient blade assembly composed of blade groups and a transferring circuit board electrically connected to both the top blade group and the bottom blade group and having insertion holes defined in two opposite sides of the transferring circuit board to correspond to and receive therein metal arms extending from one side of each of the two side circuit boards to allow the transferring circuit board to have an electrical connection to both the side circuit boards.

9 Claims, 7 Drawing Sheets

COMMUNICATION CONNECTOR WITH TWO LAYERED CORE MODULE

BACKGROUND OF THE INVENTION

1. Field of the Invention

The present invention relates to a communication connector, and more particularly to a communication connector having two layered core modules to facilitate assembly thereof.

2. Description of the Prior Art

Different communication connectors, for example, RJ45, RJ11 or RJ12 are widely used in various fields to transmit signals of different kinds. Although all these different connectors are used to transmit signals from one location to the other, interference and static may still be factors influencing the quality of the signals.

In order to have a better understanding of the existing art, it is noted that FIGS. 11 and 12 show a conventional communication connector (60). The connector (60) includes a resilient blade assembly (61), a circuit board (62) electrically connected to the resilient blade assembly (61), two side circuit boards (63,64) respectively provided on opposite sides of the circuit board (62) and a base (65) provided at a bottom of each of the two side circuit boards (63,64) and having multiple legs (650) extending outward therefrom for connection to other electrical components. Both the base (65) and the resilient blade assembly (61) are thus vertical to the side circuit boards (63,64). The resilient blade assembly (61) is composed of first blades (610) and second blades (610A). In addition, multiple coils (630,640) are respectively provided on two facing sides of both the side circuit boards (63,64) with a plastic film (66) separating the coils (630,640). However, even with the plastic film (66), interference exists between the two groups of the coils (630,640) such that the signal quality is affected due to the interference.

To overcome the shortcomings, the present invention tends to provide an improved communication connector to mitigate the aforementioned problems.

SUMMARY OF THE INVENTION

The primary objective of the present invention is to provide a communication connector with two layered core module to isolate coils so as to obviate possibility of interference between the coils.

In order to accomplish the aforementioned objective, the communication connector of the present invention includes a resilient blade assembly, a coil seat, a terminal seat and two side circuit boards. The coil seat is provided with two isolated compartments to respectively receive therein two groups of coils such that interference between the two groups of coils is avoided.

In a different objective of the present invention, the coil seat has multiple tapered cutouts respectively defined in one side of each of the two compartments for easy access of the coils.

Still, a further objective of the present invention is that the terminal seat is provided with multiple long slits and multiple short slits defined in two opposite sides of the terminal seat to correspond to long legs and short legs respectively extending from a bottom side of the coil seat so that after the long legs are inserted into the long slits and the short legs are inserted into the short slits, combination between the coil seat and the terminal seat is accomplished.

A further objective of the present invention is that each of the long slits and short slits has a leg received therein and having an L cross section such that free ends of the coils are able to be mounted around free ends of each of the legs after the coils are mounted inside each of the two compartments.

In yet another objective of the present invention, the coil seat is provided with multiple coil rods respectively extending from a side face of each of the two compartments to connect to the coils in each of the two compartments.

Other objects, advantages and novel features of the invention will become more apparent from the following detailed description when taken in conjunction with the accompanying drawings.

DETAILED DESCRIPTION OF THE PREFERRED EMBODIMENT

Figure 1:
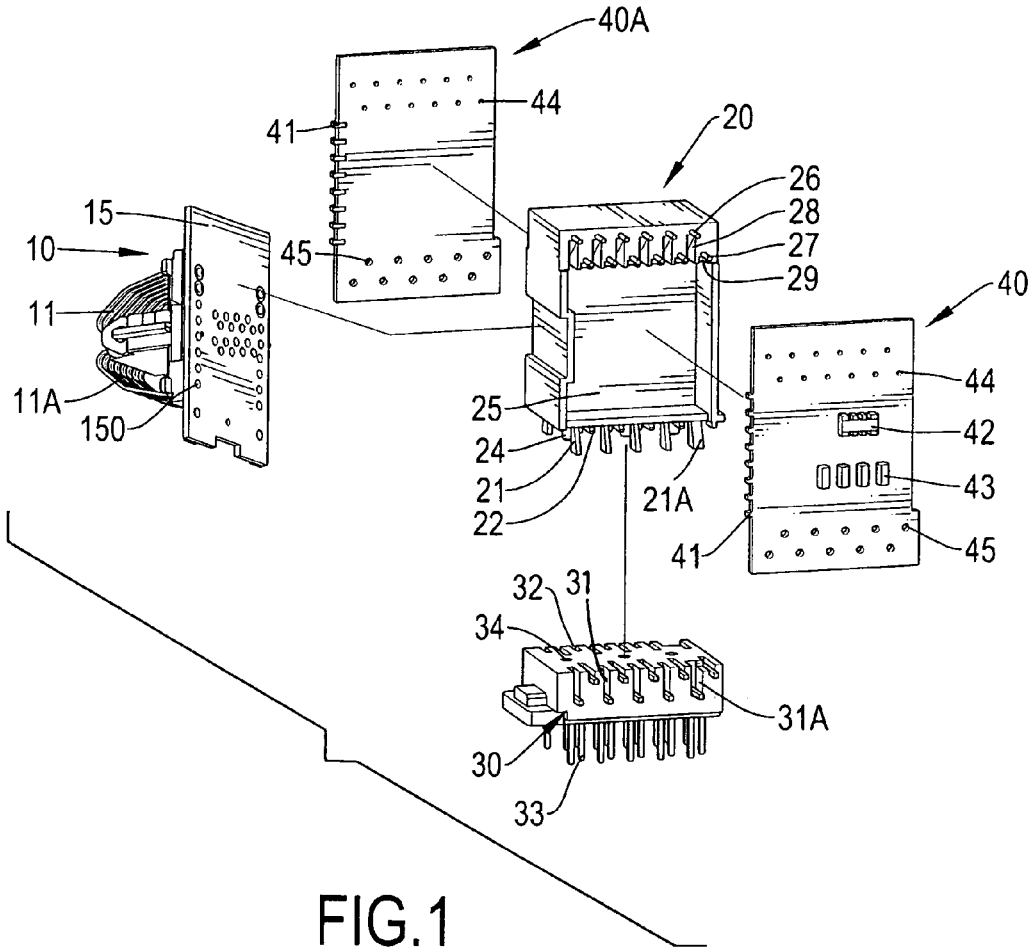
FIG. 1 is an exploded perspective view of the communication connector of the present invention.
Figure 2:
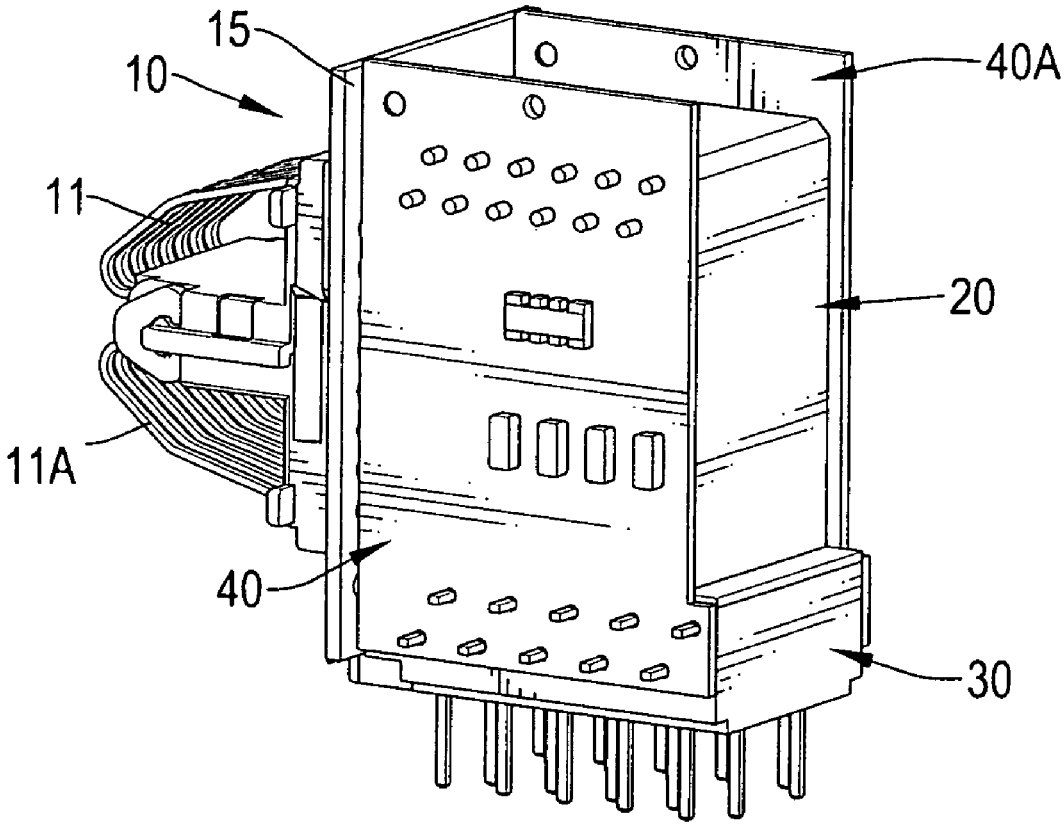
FIG. 2 is a perspective view showing that the communication connector in FIG. 1 is assembled.
Figure 5:
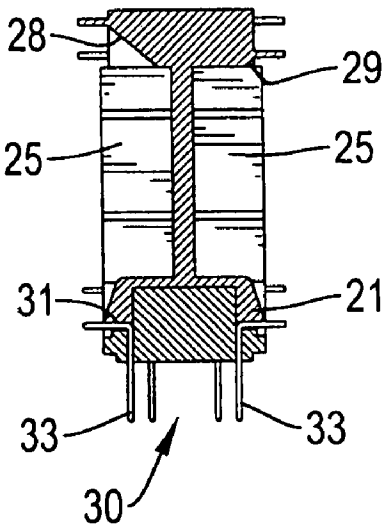
FIG. 5 is another schematic side plan view showing the location of the tapered cutouts in the coil seat and the long slits in the terminal seat.
Figure 4:
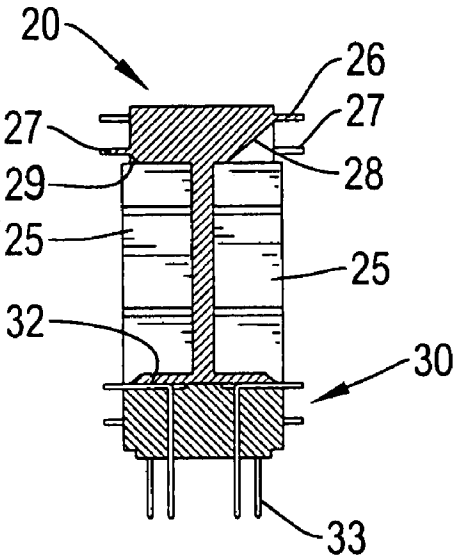
FIG. 4 is a schematic side plan view showing the location of the tapered cutouts in the coil seat and the short slits in the terminal seat.
Figure 3:
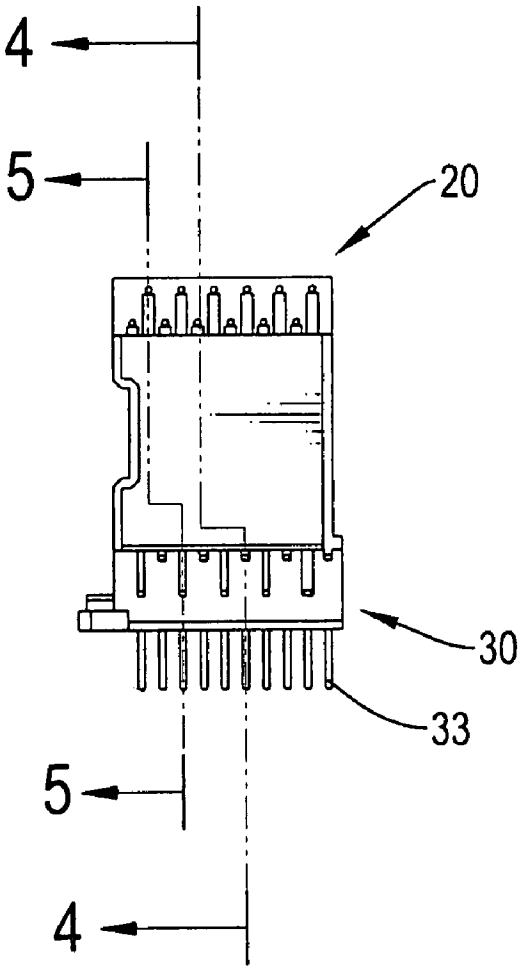
FIG. 3 is a schematic side plan view showing the combination between the coil seat and the terminal seat of the present invention.

With reference to FIGS. 1~5, it is noted that the communication connector in accordance with the present invention includes a resilient blade assembly (10), a coil seat (20), a terminal seat (30) and two side circuit boards (40,40A).

The resilient blade assembly (10) is composed of a top blade group (11), a bottom blade group (11A) and a transferring circuit board (15) electrically connected to both the top blade group (11) and the bottom blade group (11A) and having insertion holes (150) defined in two opposite sides of the transferring circuit board (15).

The coil seat (20) is made of plastic and has multiple long legs (21) and short legs (22) alternately extending from a bottom face of the coil seat (20). A widest long leg (21A) is additionally formed on the bottom face of the coil seat (20)

and inserting rods (24) are formed on the bottom face of the coil seat (20). The coil seat (20) further has two compartments (25) respectively defined in two opposite sides of the coil seat (20) and multiple coil rods (26,27) respectively extending from long coil cutouts (28) and short coil cutouts (29) formed on one end of each of the two compartments (25). Each of the long coil cutouts (28) and of the short coil cutouts (29) is tapered.

The terminal seat (30) is made of plastic and has multiple L shaped long slits (31) and L shaped short slits (32) defined alternatively in two adjacent sides of the terminal seat (30) and an L shaped leg (33) is received in each of the long slits (31) and of the short slits (32). Receiving holes (34) are defined in a top face of the terminal seat (30) to correspond to and receive therein the inserting rods (24) of the coil seat (20). A widest long slit (31A) is defined in a corner of the terminal seat (30) to correspond to and receive therein the widest long leg (21A) of the coil seat (20).

Each of the two side circuit boards (40,40A) has multiple holes (44) corresponding to and receiving therein the coil rods (26,27) of the coil seat (20), a resistor (42) mounted on one side of the side circuit board (40,40A), a capacitor (43) also mounted on one side of the side circuit board (40,40A) and multiple leg holes (45) corresponding to and receiving therein free ends of the legs (33) that extend from a top face of the terminal seat (30).

Figure 6:
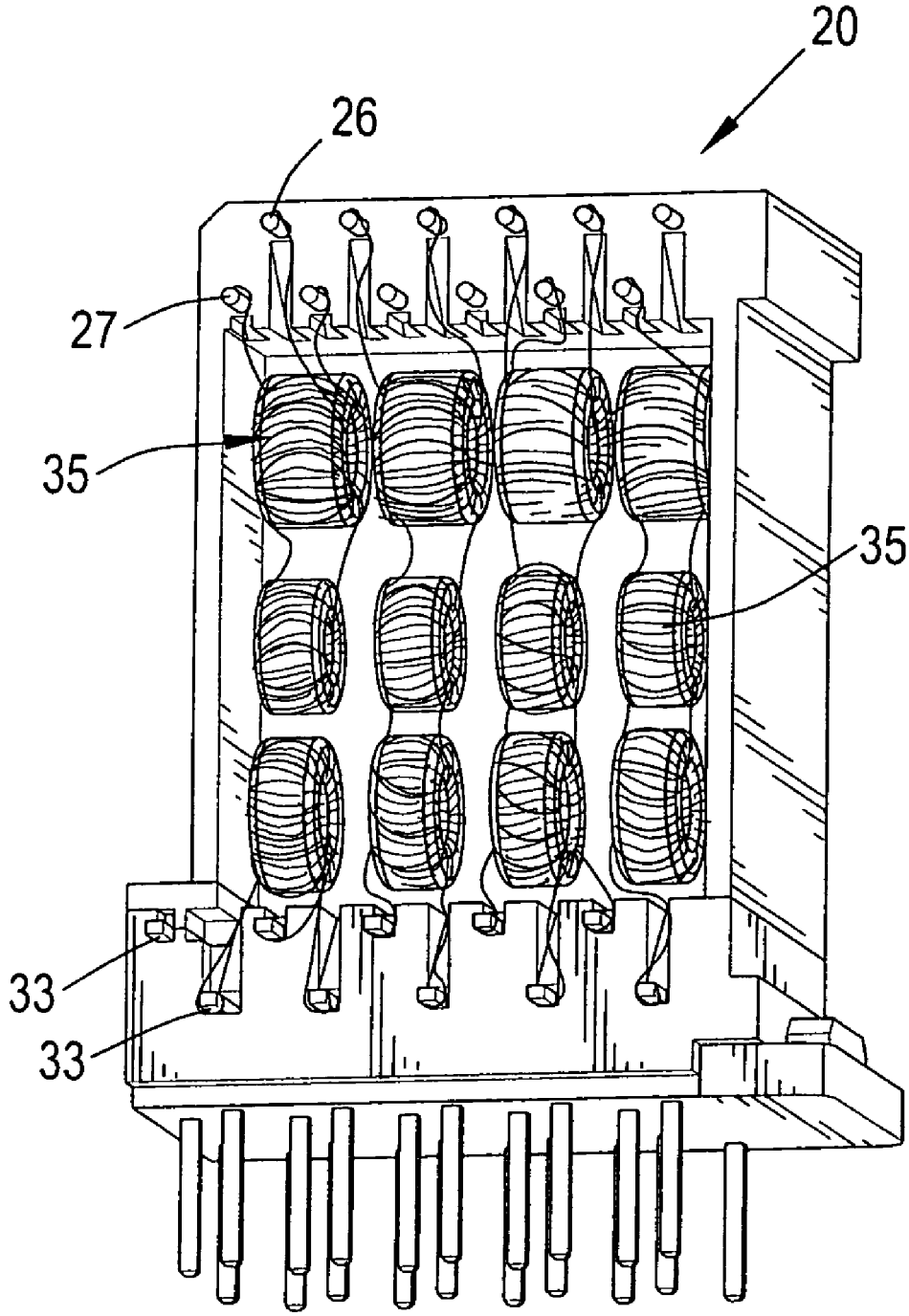
FIG. 6 is a perspective view of the coil seat with coils received therein.
Figure 7:
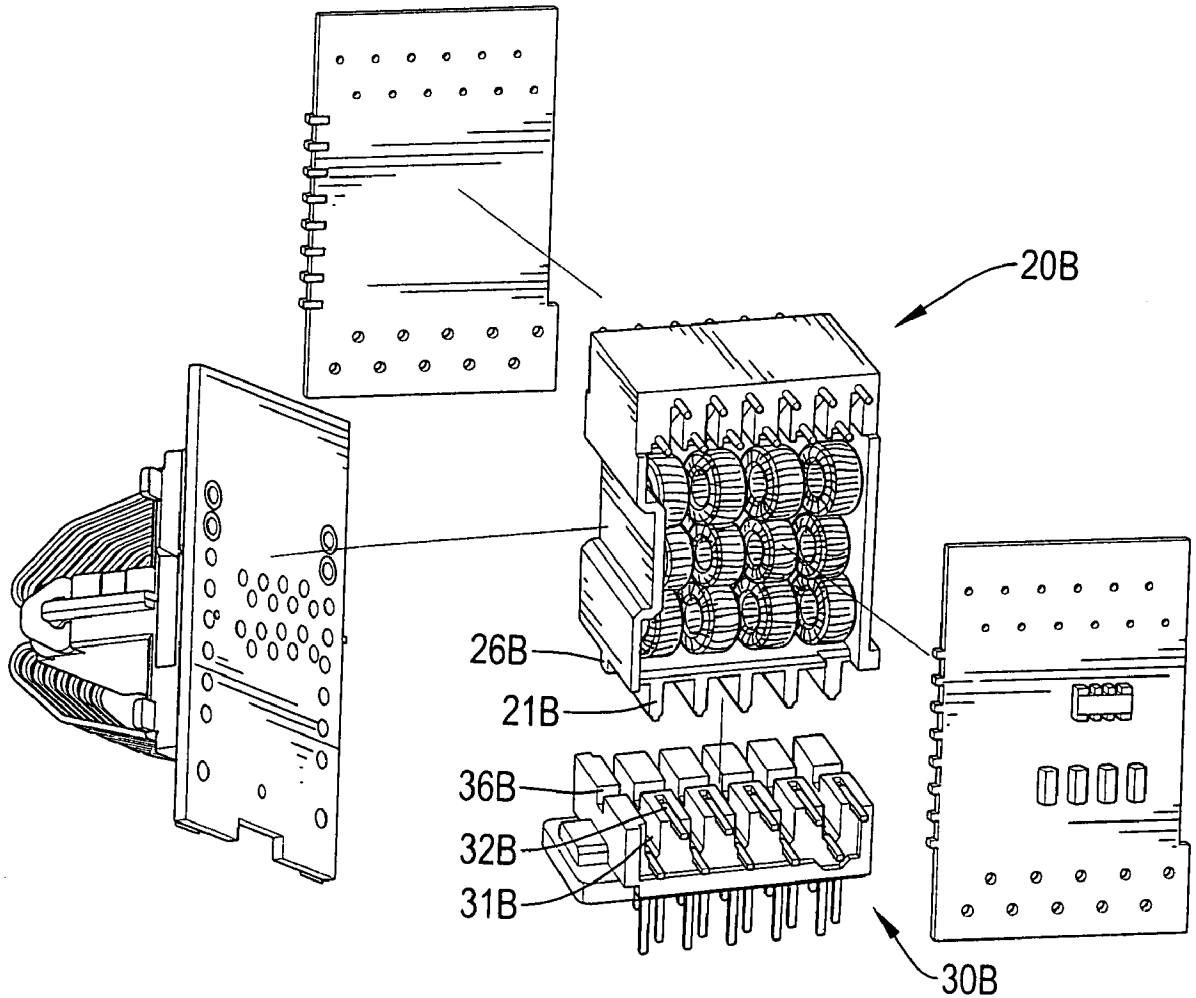
FIG. 7 is an exploded perspective view of the communication connector in a different embodiment.
Figure 10:
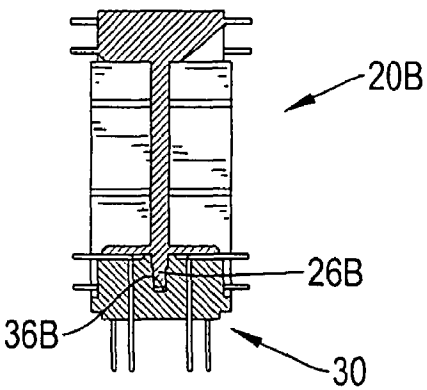
FIG. 10 is a schematic side plan view showing the bar of the coil seat and the corresponding indentation in the terminal seat.
Figure 9:
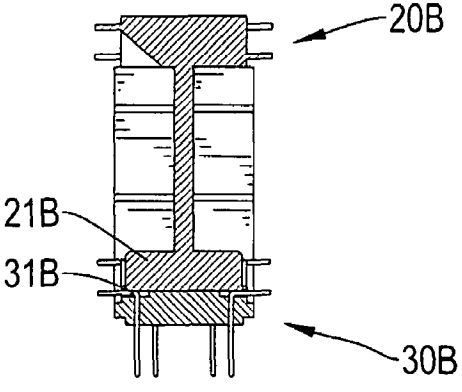
FIG. 9 is a schematic side plan view showing the combination between the coil seat and the terminal seat of the present invention, wherein the longest long leg from the coil seat is inserted into the longest long slit.
Figure 8:
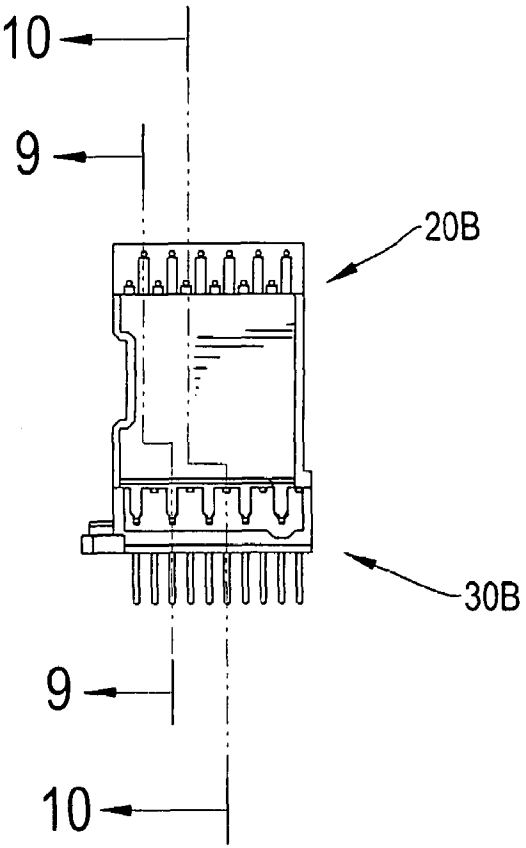
FIG. 8 is a schematic side plan view showing the combination between the coil seat and the terminal seat of the present invention.
Figure 11:
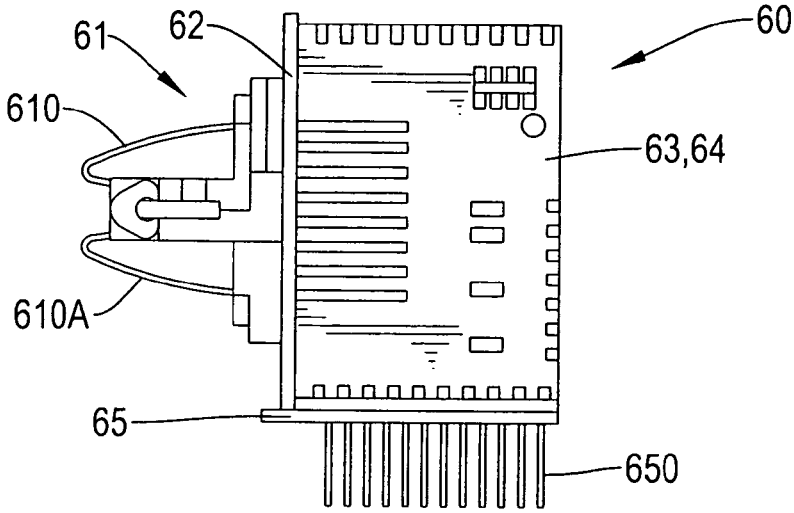
FIG. 11 is a side plan view of a conventional communication connector.
Figure 12:
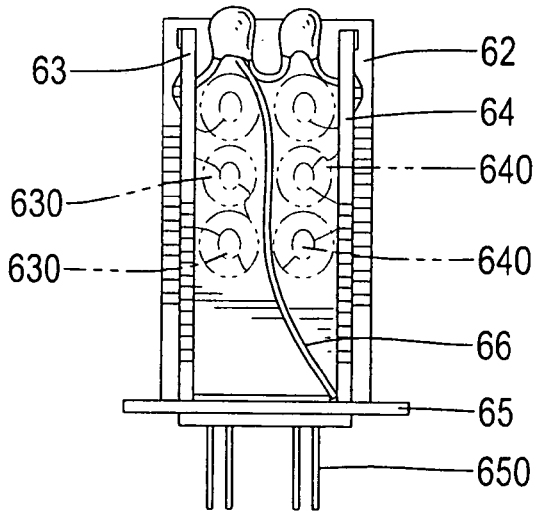
FIG. 12 side plan view of the conventional communication connector in an angle different from that of FIG. 11.

When the communication connector of the present invention is assembled, the long legs (21) and the short legs (22) of the coil seat (20) are inserted into the long slit (31) and the short slit (32) of the terminal seat (30) respectively. Simultaneously, the inserting rods (24) are inserted into the receiving holes (34) of the terminal seat (30). Also, the widest long leg (21A) is inserted into the widest long slit (31A) to position the coil seat (20) relative to the terminal seat (30) and to finish the assembly between the coil seat (20) and the terminal seat (30). With reference to FIG. 6, then coils (35) are securely received in each of the two compartments (25) with one free end of each of the coils (35) securely connected to one of the coil rods (26,27) that are respectively received in the long coil cutouts (28) and the short cutouts (29) and the other free end of each of the coils (35) securely connected to one of the free ends of the legs (33) that are respectively received in the long slits (31) and the short slits (32). For easy entering each of the coil cutouts (28,29), a bottom face of each of the coil cutouts (28,29) is tapered.

Due to the extension of the L shaped legs (33) from opposite sides of the top face of the terminal seat (30), when the two side circuit boards (40,40A) are to be assembled with the combination of the terminal seat (30) and the coil seat (20), the leg holes (45) are aligned with the free ends of the legs (33) that extend from the adjacent sides of the terminal seat (30) so as to receive therein the free ends of the legs (33). Also, the holes (44) are aligned with the free ends of the coil rods (28,29) such that when the free ends of the legs (33) are received inside the leg holes (45), the free ends of the coil rods (28,29) are received in the corresponding holes (44) of the two side circuit boards (40,40A).

In order to have electrical connection between the two side circuit boards (40,40A) and the circuit board (15), each of the two side circuit boards (40,40A) is provided with metal arms (41) extending from one side of each of the two side circuit boards (40,40A) to correspond to the insertion holes (150) of the transferring circuit board (15). Therefore, after the combination among the coil seat (20), the terminal seat (30) and the two side circuit boards (40,40A) is finished, inserting the arms (41) of each of the two side circuit boards (40,40A) into the insertion holes (150) finishes the entire assembly of the communication connector of the present invention.

From the above description, it is noted that the coils (35) are respectively received in two isolated compartments (25) inside the coil seat (20) so that interference between two groups of coils (35) is avoided or obviated to minimum.

With reference to FIGS. 7-10, another embodiment of the present invention is shown, wherein the long slits (31B) of the terminal seat (30B) are now in communication with one another via a passage (36B) orthogonally defined in the top face of the terminal seat (30B). The coil seat (20B) is now provided with two rows of pressing boards (21B) separated from one another via a spacer (26B) which is inserted into the passage (36B) when the terminal seat (30B) is combined with the coil seat (20B). In the meantime, the pressing boards (21B) are then respectively inserted into the corresponding long slits (31B) to position the free ends of the coils.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A communication connector comprising:

a terminal seat having multiple legs extending from two adjacent sides of the terminal seat; and multiple long slits and short slits alternately located on the terminal seat and the legs being respectively received in each of the long slits and the short slits and extended from a side face and a bottom face of the terminal seat;

a coil seat securely and electrically connected to the terminal seat and having coils respectively received in two isolated compartments defined in two opposite sides of the coil seat;

two side circuit boards respectively connected to opposed sides of the terminal seat to sandwich therebetween the coil seat; and a resilient blade assembly composed of a top blade group, a bottom blade group and a transferring circuit board electrically connected to both the top blade group and the bottom blade group and having insertion holes defined in two opposite sides of the transferring circuit board to correspond to and receive therein metal arms extending from one side of each of the two side circuit boards to allow the transferring circuit board to have an electrical connection to both the side circuit boards.

2. The communication connector as claimed in claim 1, wherein the coil seat has multiple long legs and short legs respectively and alternately extending from a bottom face of the coil seat to be received in the long slits and the short slits of the terminal seat.

3. The communication connector as claimed in claim 2, wherein the coil seat further has inserting rods formed on the bottom face of the coil seat to correspond to and be received in receiving holes defined in the terminal seat so as to position the coil seat relative to the terminal seat.

4. The communication connector as claimed in claim 3, wherein multiple cutouts are defined in one end of each of the two isolated compartments of the coil seat and multiple coil rods are respectively received in the cutouts to correspond to free ends of the legs that extend from two adjacent sides of the terminal seat such that one free end of each of the coils is securely connected to one of the coil rods and the other free end of each of the coils is securely connected to one of the free ends of the long legs and the short legs in the terminal seat.

5. The communication connector as claimed in claim 4, wherein each of the cutouts is tapered so as to facilitate entrance of the free ends of the coils in the isolated compartments.

6. The communication connector as claimed in claim 5, wherein each of the side circuit boards is provided with leg holes to correspond to and receive therein the free ends of the legs extending from the two adjacent sides of the terminal seat.

7. The communication connector as claimed in claim 6, wherein each of the side circuit boards is provided with holes corresponding to and receiving therein free ends of the coil rods that extend from two opposed sides of the coil seat.

8. The communication connector as claimed in claim 7, wherein the terminal seat further has a passage defined in a top face thereof to communicate each of the long slits with one another and the coil seat is provided with a spacer formed on the bottom face of the coil seat and received in the passage of the terminal seat to secure engagement between the coil seat and the terminal seat.

9. The communication connector as claimed in claim 8, wherein the coil seat further has multiple pressing boards formed on the bottom face of the coil seat and separated via the spacer to be received in the long slits of the terminal seat.

* * * * *